United States Patent [19]

Liu

[11] Patent Number: 5,044,136

[45] Date of Patent: Sep. 3, 1991

[54] CONCRETE REINFORCEMENT DEVICE

[76] Inventor: Jen-Jui Liu, No. 253, Chueh-Min Rd., San-Min Dist., Kaohsiung, Taiwan

[21] Appl. No.: 507,393

[22] Filed: Apr. 10, 1990

[51] Int. Cl.[5] ..... E04B 1/00; E04B 1/18; E04C 5/16

[52] U.S. Cl. ..... 52/252; 52/253; 52/414; 52/677

[58] Field of Search ..... 52/252, 253, 414, 677

[56] References Cited

U.S. PATENT DOCUMENTS

| | | | |
|---|---|---|---|
| 4,000,954 | 12/1977 | Liuzza | 52/677 |
| 4,866,903 | 9/1989 | Ferstay | 52/677 |
| 4,905,440 | 3/1990 | Schilger | 52/414 X |

FOREIGN PATENT DOCUMENTS

| | | | |
|---|---|---|---|
| 2941796 | 4/1981 | Fed. Rep. of Germany | 52/677 |

*Primary Examiner*—Richard E. Chilcot, Jr.
*Assistant Examiner*—Deborah McGann Ripley
*Attorney, Agent, or Firm*—Ladas & Parry

[57] ABSTRACT

A concrete reinforcement device includes a plurality of spaced vertical reinforcement rods 12, and tiers of horizontal connecting plates 10, 11 to space and interconnect the reinforcement rods 12, the connecting plates in each tier having a peripheral edge provided with spaced apart notches 15 which are engaged with the vertical reinforcement rods 12 respectively and connected firmly therewith by welding, the connecting plates 10, 11 in each tier confining a hole for the passage of concrete.

5 Claims, 14 Drawing Sheets

CONCRETE REINFORCEMENT DEVICE

BACKGROUND OF THE INVENTION

This invention relates to a concrete reinforcement device, and particularly to a concrete reinforcement device having a plurality of reinforcement rods erected vertically and horizontal plates to space and fasten the vertical reinforcement rods.

Conventional reinforcement cages used for the reinforcement of concrete walls, concrete columns, etc., are erected by using a plurality of reinforcement rods and reinforcement wires to space and fasten the reinforcement rods.

Preconstructed reinforcement cages of the abovedescribed conventional type are used in the construction of retaining walls. A retaining wall for a basement is constructed by in-situ forming a continuous concrete slabs in an excavated cavity extending around the area in which the basement will be formed. The cavity is made section by section for the in-situ formation of the retaining wall part by part rather than being formed entirely at the same time. In forming the retaining wall, pre-constructed reinforcement cages are lowered into the excavated sections of cavities for the reinforcement of the retaining wall. The reinforcement cages are arranged such that they can be connected to each other as well as connected to other reinforcement bars or rods lying horizontally to reinforce concrete floors, concrete joists, etc. However, the conventional reinforcement cages suffer from disadvantages in that the reinforcement cages can not be constructed easily and that the connections between the reinforcement cages cannot be accomplished conveniently.

SUMMARY OF THE INVENTION

The present invention provides an improved concrete reinforcement device which can be easily constructed. The device includes a plurality of spaced vertical reinforcement rods, and tiers of horizontal connecting plate means to space and interconnect the reinforcement rods, each connecting plate means having a peripheral edge provided with spaced notches which are engaged with the vertical reinforcement rods respectively and connected firmly therewith by welding, each connecting plate means having a hole for the passage of concrete. The connecting plate means in a tier may be a one-piece plate or a plurality of interconnected plate members.

The concrete reinforcement device may further include a cover plate extending transversely relative to the vertical reinforcement rods and having one side contacted with parts of the vertical reinforcement rods, the cover plate being removably attached to and covering parts of the vertical reinforcement rods, which are then exposed after the formation of the concrete construction.

The concrete reinforcement device of the invention may further include transverse rods to be welded to the exposed parts of the vertical reinforcement rods. Transverse steel plates may be provided around parts of the vertical reinforcement rods and each have one side welded to the vertical reinforcement rods, Each steel plate has openings in alignment with the openings of another opposite one of the steel plates. Tube members extend between the steel plates and each having two ends fitted in aligned openings of the steel plates.

The present exemplary preferred embodiment will be described in detail with reference to the accompanying drawings, in which:

DETAILED DESCRIPTION OF THE PREFERRED EMBODIMENTS

Figure 1:
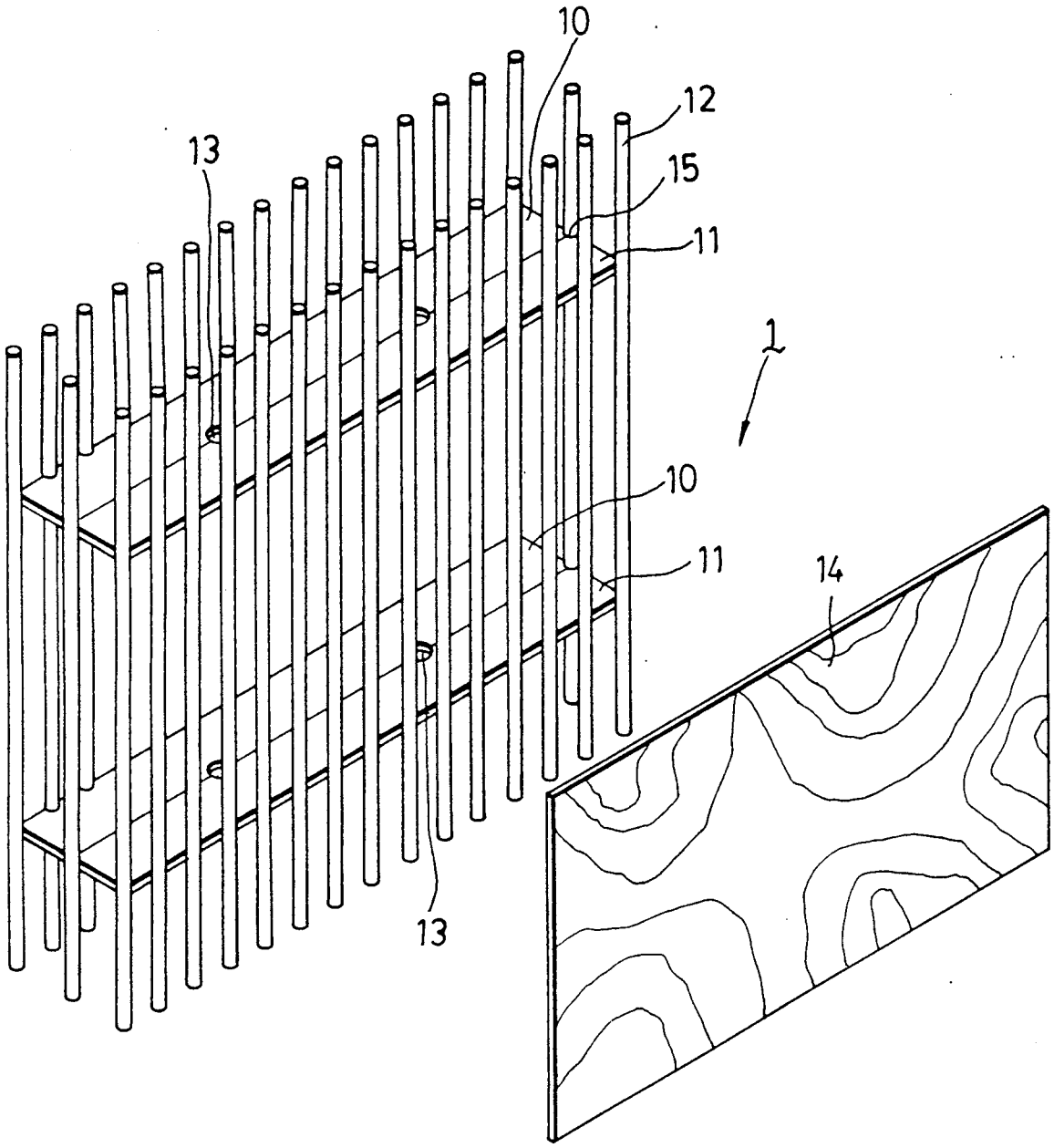
FIG. 1 shows a first embodiment of the reinforcement device of the present invention.

Referring to FIG. 1, a reinforcement device 1 includes tiers of horizontal connecting plates 10, 11 which are welded to one another and a plurality of vertical reinforcement rods 12 welded to the horizontal plates 10, 11. The horizontal plates 10, 11 are provided with peripheral notches 15 to receive portions of the vertical rods 12 which are welded thereto. Holes 13 are provided in the connecting plates 10, 11 to permit concrete to flow therethrough. A wooden cover plate 14 is fastened removably to one side of the reinforcement device such as by tying with a rope. The reinforcement device 1 may be used to reinforce a concrete wall.

Figure 3:
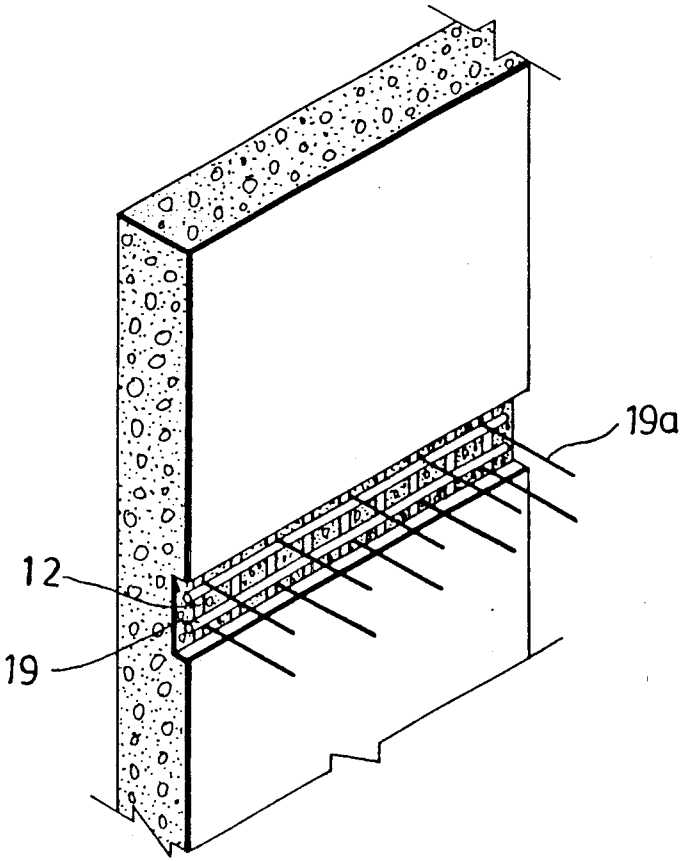
FIG. 3 shows how to connect horizontal reinforcement rods to the wall of FIG. 2.
Figure 2:
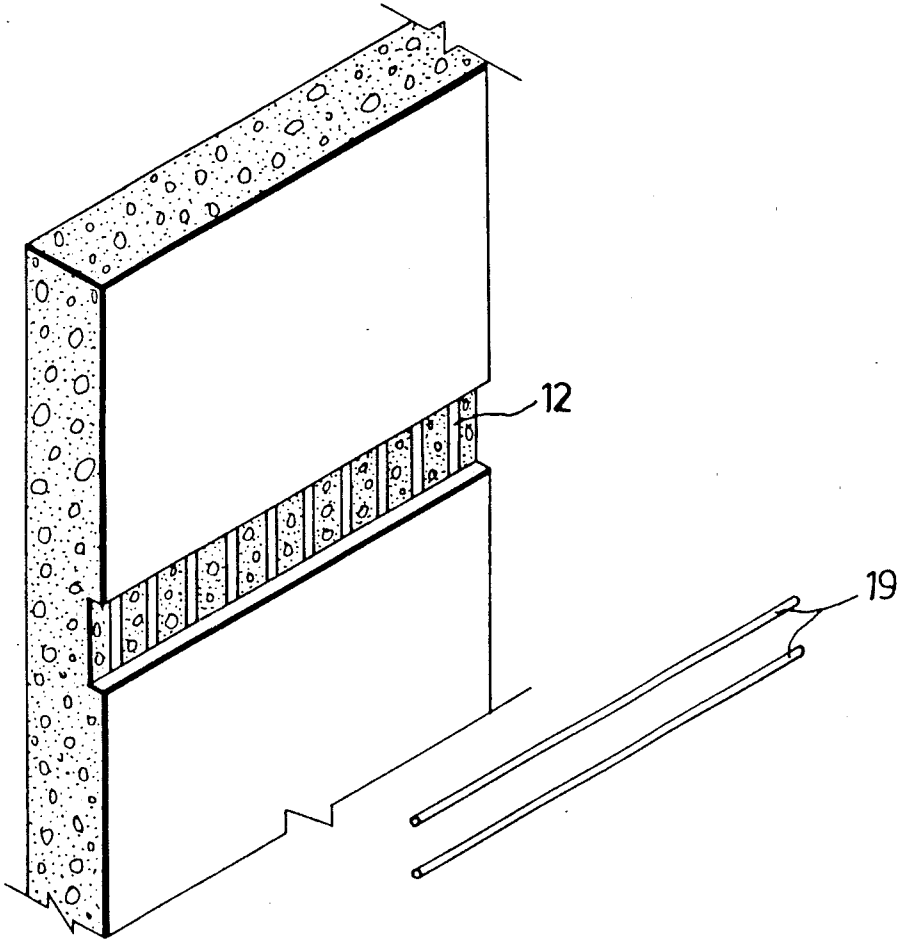
FIG. 2 shows a portion of a retaining wall reinforced by the reinforcement device of FIG. 1.
Figure 4:
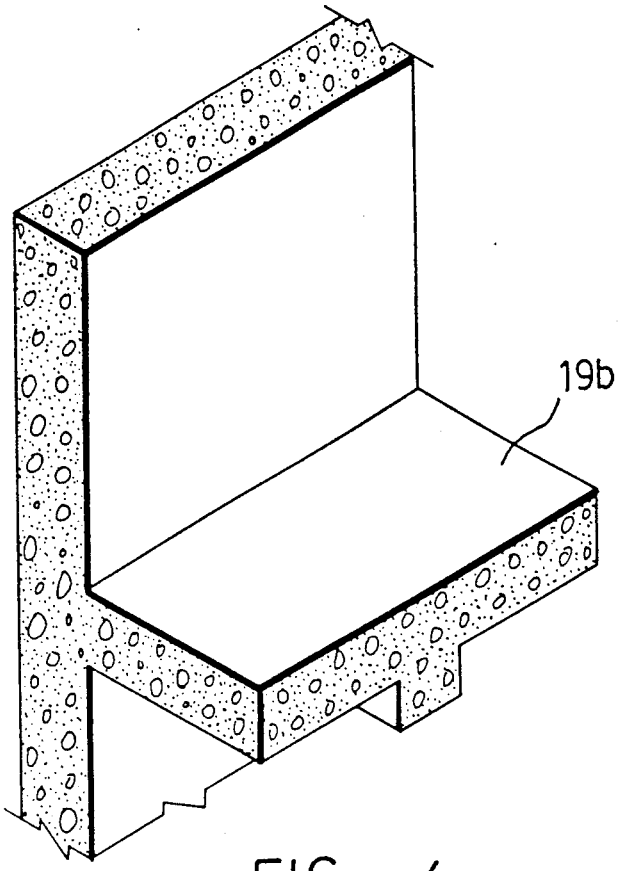
FIG. 4 shows the retaining wall connected to a horizontal floor.

A portion of a retaining wall of a basement incorporating the reinforcement device 1 is shown in FIGS. 2 and 3. The retaining wall is formed by lowering the reinforcement device 1 with the wooden plate 14 into an excavated space and then pouring concrete into the space. After the wooden plate 14 is removed, portions of vertical reinforcement rods 12 are exposed. Horizontal reinforcement rods 19 are welded to the exposed portions of the rods 12 and then horizontal reinforcement rods **19*a* are welded to the horizontal reinforcement rods 19. The horizontal reinforcement rods 19*a* are used to reinforce a floor structure 19*b* as shown in FIG. 4**.

Figure 5:
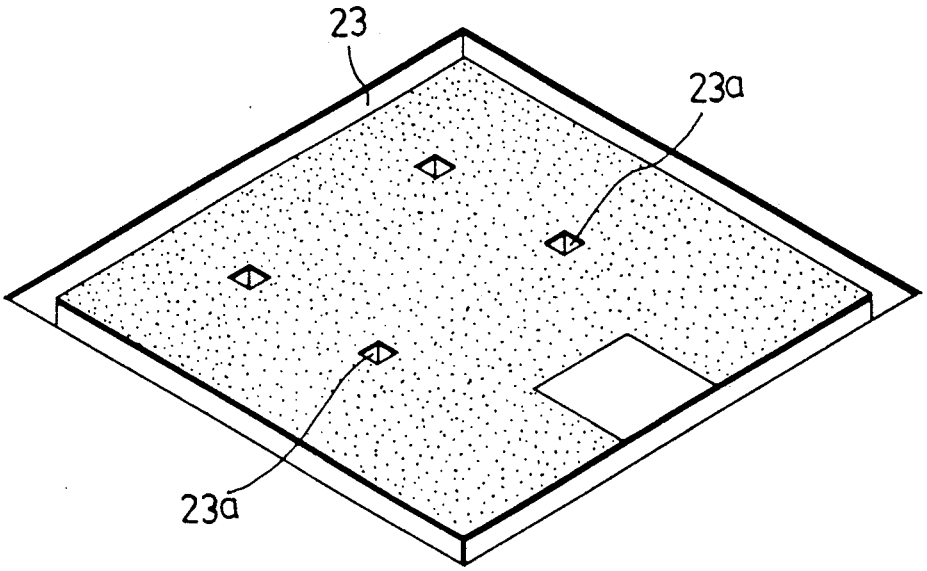
FIG. 5 shows an area within which a basement will be formed.
Figure 6:
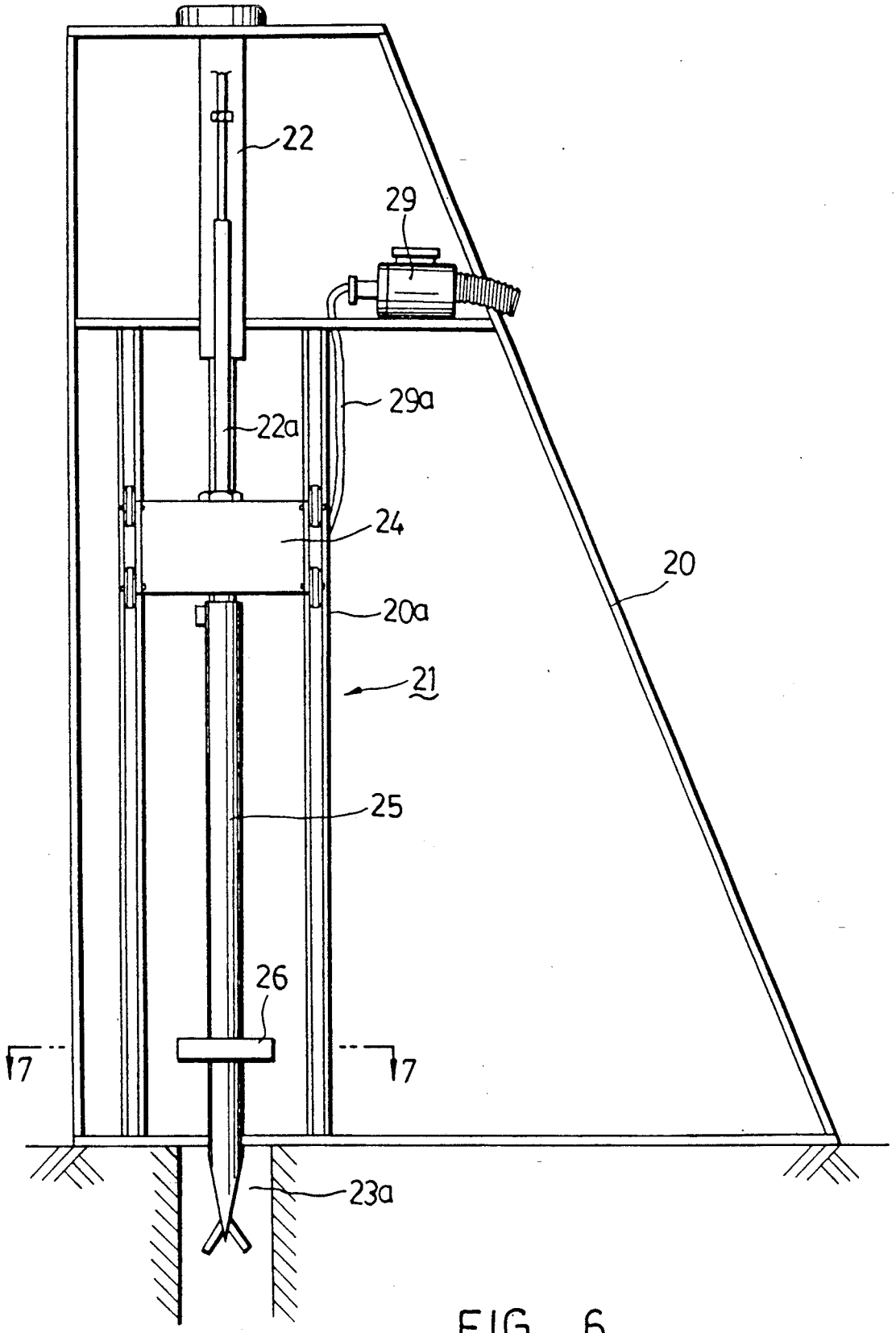
FIG. 6 shows an excavating device to be used for forming holes in the ground.
Figure 7:
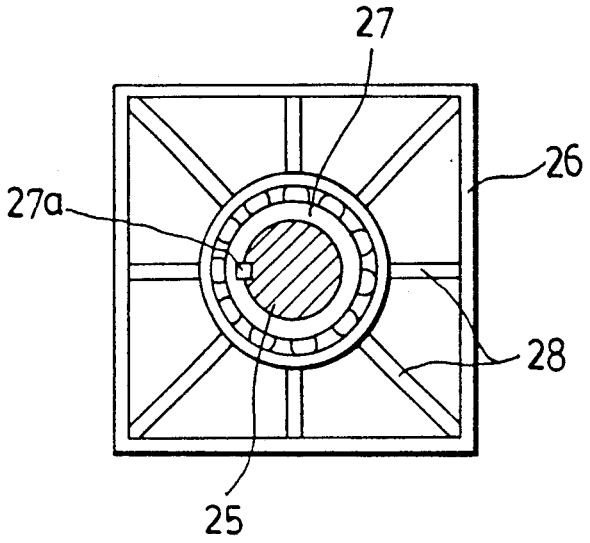
FIG. 7 is a sectional view taken along line 7—7 of FIG. 6.
Figure 8:
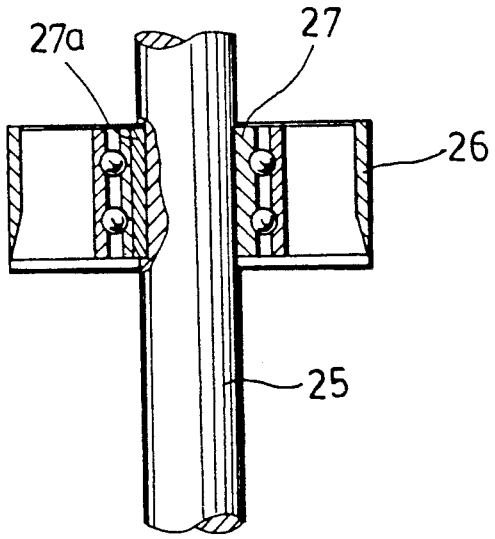
FIG. 8 is a fragmentary view of a driller shown in FIG. 6.

Referring to FIG. 5, when a long retaining wall is to be constructed for a large basement, holes **23*a* of rectangular cross-section are formed within the area surrounded by a continuous excavated hole 23 in which the retaining wall will be formed. The holes 23***a* can be created by using a support 20 and an excavating device 21 as shown in FIGS. 6, 7, 8. The drilling device includes a hydraulic device 22 mounted on the upper portion of the support 20 and a screw type driller 25. The hydraulic device 22 has a piston rod 22*a* connected to a hydraulic rotary actuator 24 which in turn is connected to the screw type drilling rod 25. The hydraulic rotary actuator 24 is mounted slideably on a vertical rail 20*a* of the support 20 and can be moved upward or downward by means of the piston rod 22*a*. The hydraulic rotary actuator 24 rotates the screw type driller 25 whereas the piston rod 22*a* drives the actuator 24 and the driller 25 downwards.

The screw type driller 25 incorporates a rectangular cutter 26 which is connected to a bearing member 27 by means of radial struts 28 as shown in FIGS. 7 and 8. The bearing member 27 is attached to the driller 25 and engages with the driller 25 through a key 27*a*. Therefore, the bearing member 27 can rotate together with the driller 5 and the rectangular cutter 26 moves axially without rotation. When the hydraulic member 22 and the hydraulic rotary actuator 24 are operated to drive downward and rotate the driller 25, the driller 25 starts drilling and excavating soil. While the driller 25 drills a circular hole, the rectangular cutter 26 cuts the surrounding soil into a rectangular hole. To facilitate the removal of soil from the drilled hole, water is jetted into the soil so as to soften the soil. In addition, in order to remove soil efficiently from the drilled hole, a pump 29 is provided on the ground to draw out the soil which is formed into a slurry. The pump 29 is connected to a pipe 29*a* which is lowered into the ground.

Figure 9:
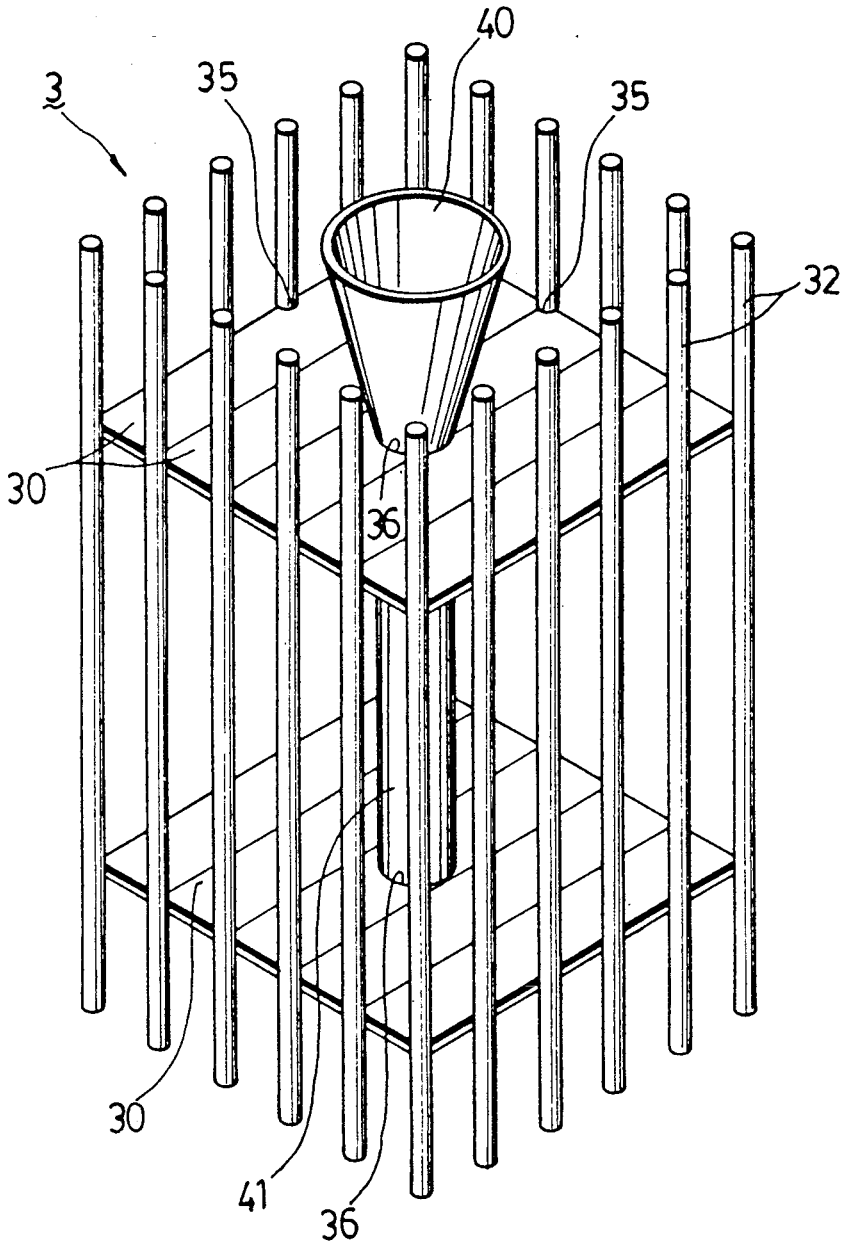
FIGS. 9 and 10 show another embodiment of the reinforcement device of the present invention.
Figure 10:
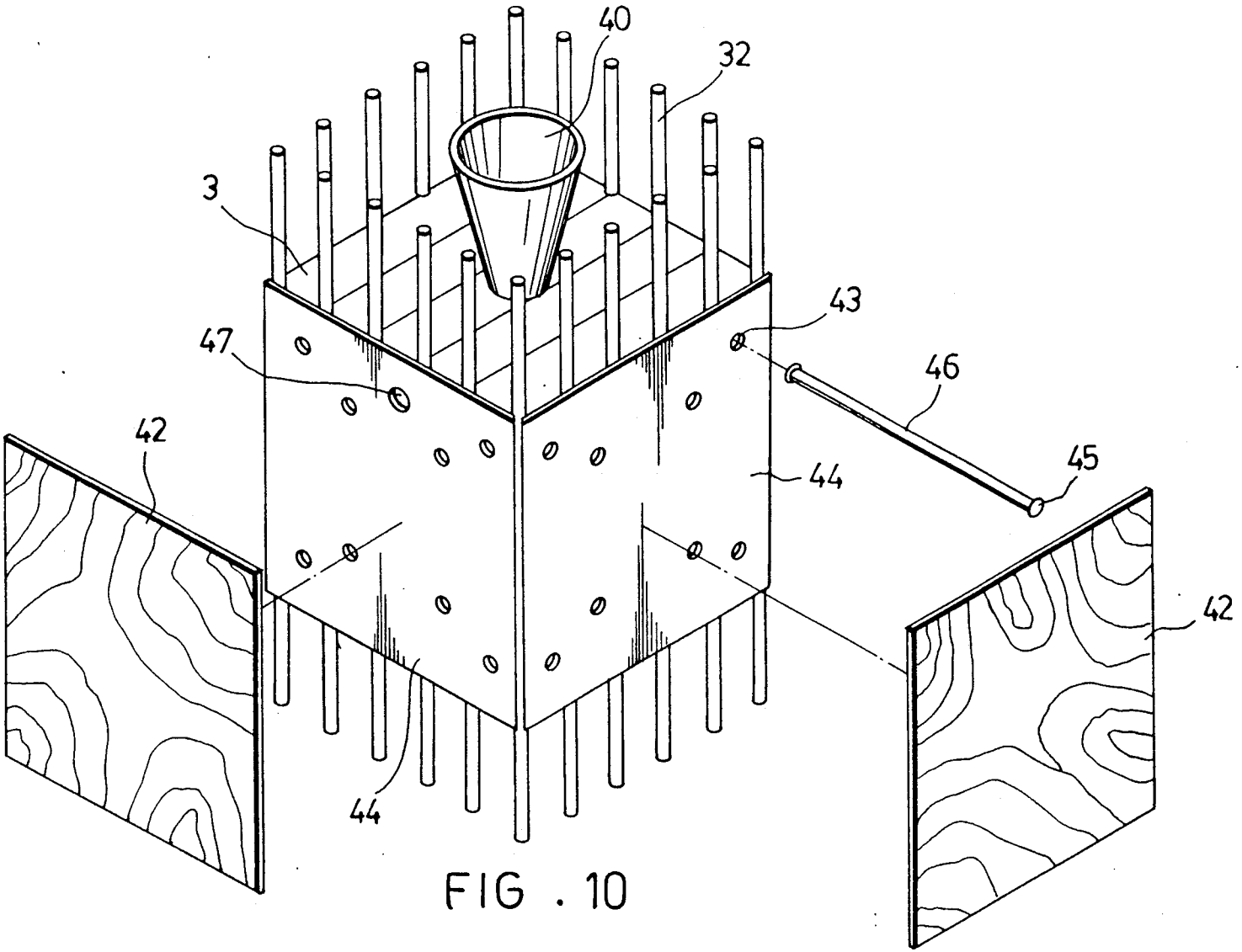
Figure 11:
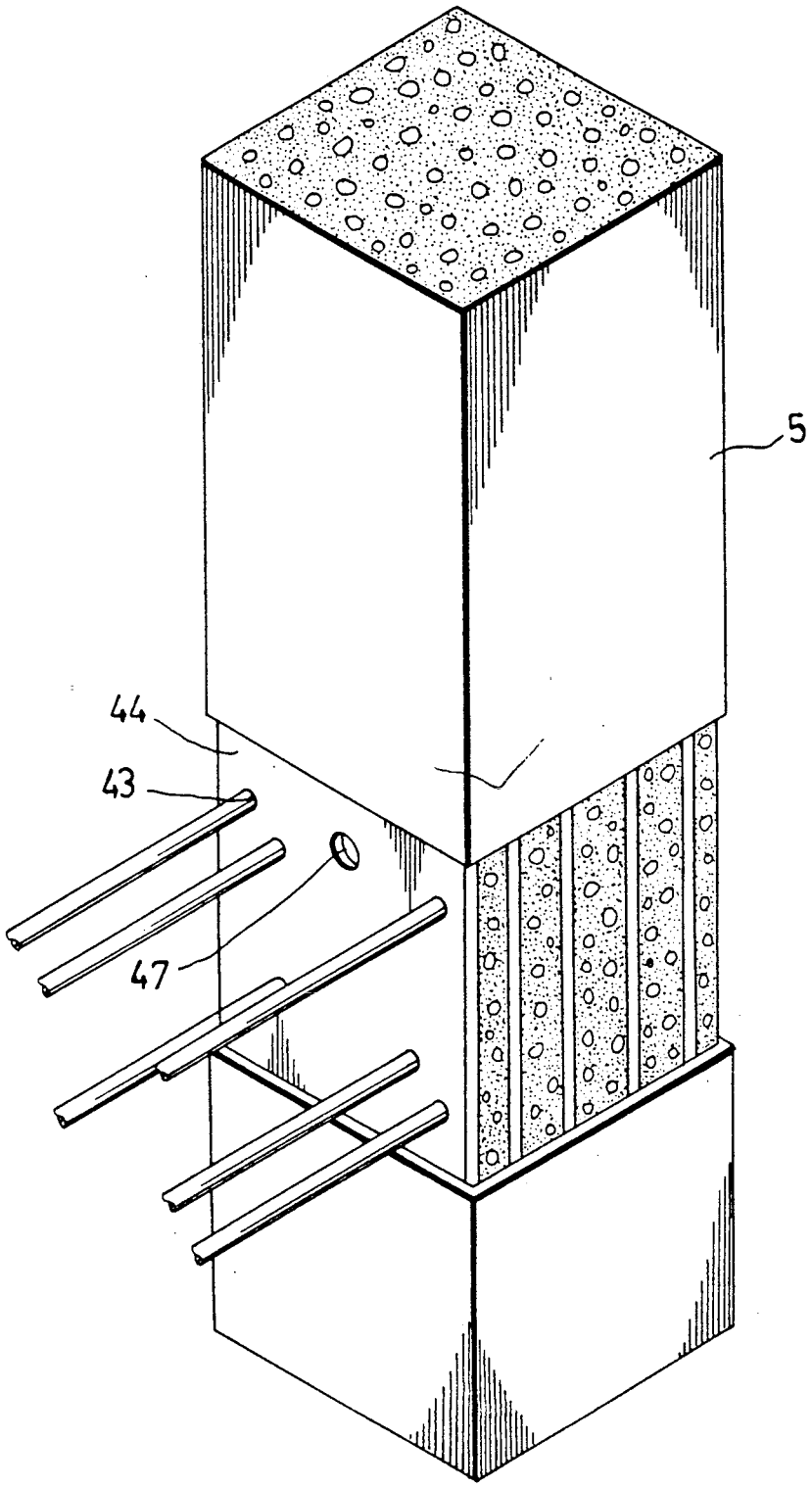
FIG. 11 shows a concrete column reinforced with the reinforcement device of FIG. 9.

After rectangular holes 23*a* are formed, reinforcement devices 3 as shown in FIG. 9 are lowered into the holes 23*a* to reinforce vertical concrete posts which will be formed in the holes 23*a*. Each of the reinforcement devices 3 includes tiers of horizontal connecting plates 30 and vertical reinforcement rods 32 welded to the horizontal plates 30. Each tier includes a plurality of horizontal connecting plates 30 welded to each other and the central plates thereof are provided with holes 36. The periphery of the interconnected plates 30 are provided with notches 35 to be engaged and welded with the rods 32. A hopper 40 is fitted into the hole 36 of the upper tier and connected to a pipe 48 which extends to the hole 36 of the lower tier. Referring to FIG. 10, vertical steel plates 44 are attached to the vertical reinforcement rods 32 around a space between the upper and lower tiers of the horizontal connecting plates. The vertical steel plates 44 are provided with holes 43 which are staggered with each other but distributed evenly. The holes 43 are employed for the insertion of tubes 46 each of which has two flared open ends 45 terminating respectively at two opposite holes 43, one in one of the vertical surrounding plates 44 and the other in the opposite vertical plate 44. Finally, the surrounding vertical plates 44 are covered removably with wooden plates 42. After concrete is poured into each rectangular hole 23*a* of FIG. 5, a column 5 shown in FIG. 11 is formed in each hole 23*a*.

Figure 12:
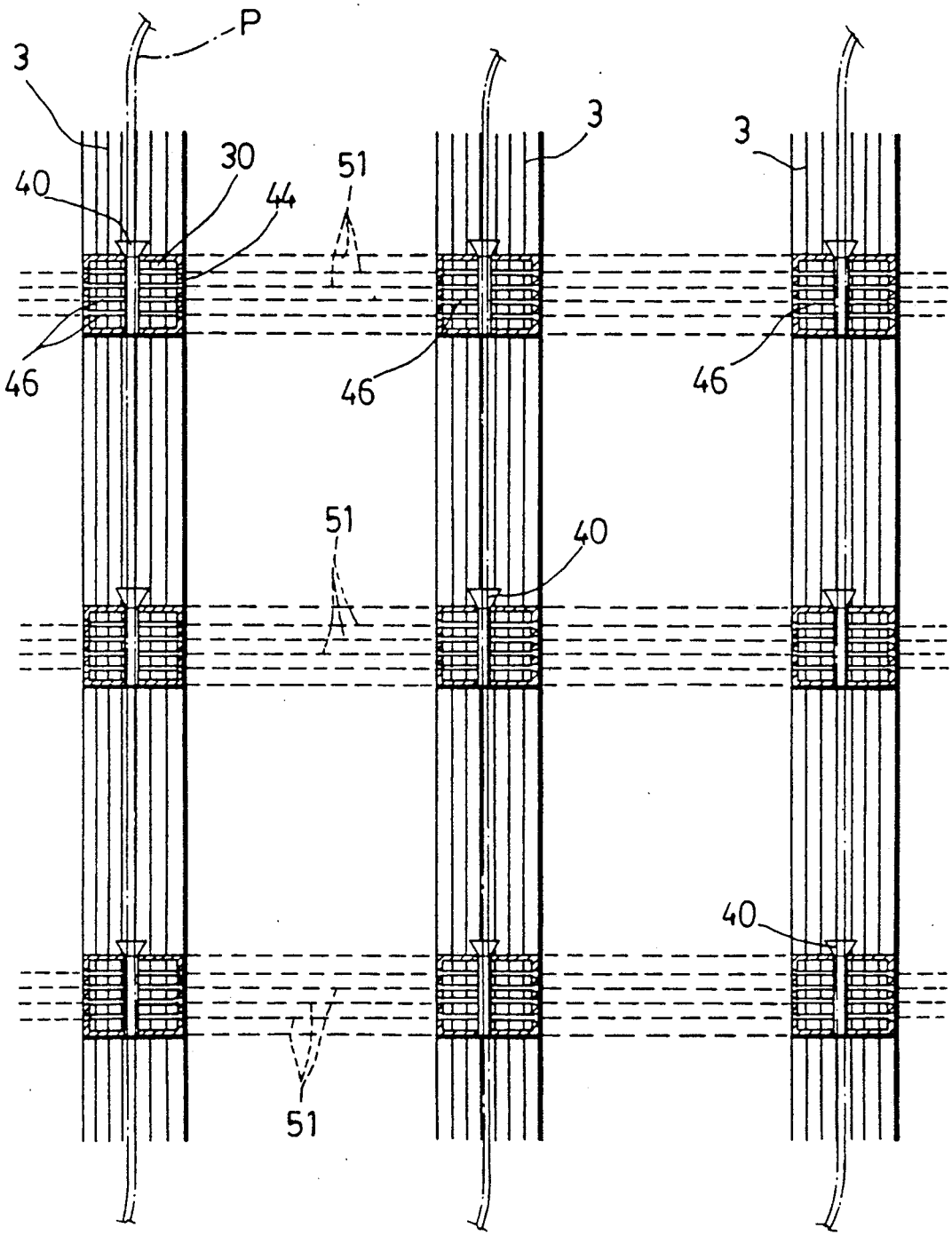
FIG. 12 shows how horizontal reinforcement members are connected to the reinforcement device of FIG. 9.

FIG. 12 shows that reinforcement devices 3 are erected in the holes 23*a* of FIG. 6. Phantom lines 51 show horizontal reinforcement bars to reinforce horizontal concrete joists of the basement. These horizontal reinforcement bars are connected to the reinforcement devices 3 by being inserted into the tubes 46 through the holes 43 of the exposed vertical plates 44 after concrete columns 5 of FIG. 11 are formed. Pipes "P" are lowered to the bottoms of the reinforcement devices 3 for grouting.

Figure 13:
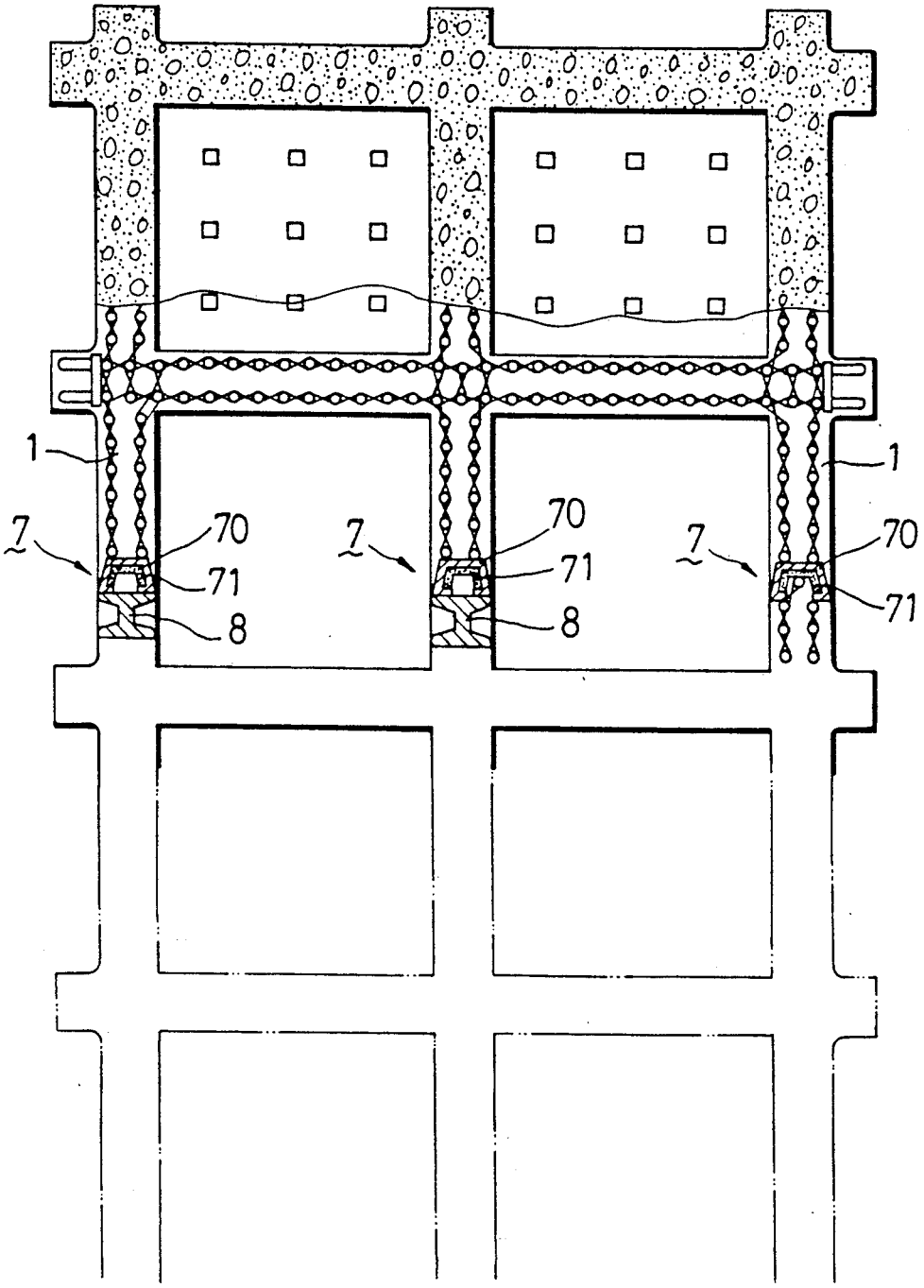
FIG. 13 shows how reinforcement devices of FIG. 1 are interconnected in the construction of a large retaining wall.

Referring to FIG. 13, reinforcement devices 1 shown in FIG. 1 are used in a long retaining wall of a large basement. A connecting device 7 interconnects each reinforcement device 1 used to reinforce a section of the retaining wall to another reinforcement device 1 to be used in another section of the retaining wall which will be subsequently formed. The connecting device 7 includes a vertical channel-like joint plate 70 which has a concaved inner side and an opposite outer side, and a stop member 8 of I-shaped cross-section which is provided adjacent to and closes the concaved side of the channel-like plate 70. The concaved inner side of each channel-like plate 70 is lined with a cushion material 71 such as a foam.

Figure 14:
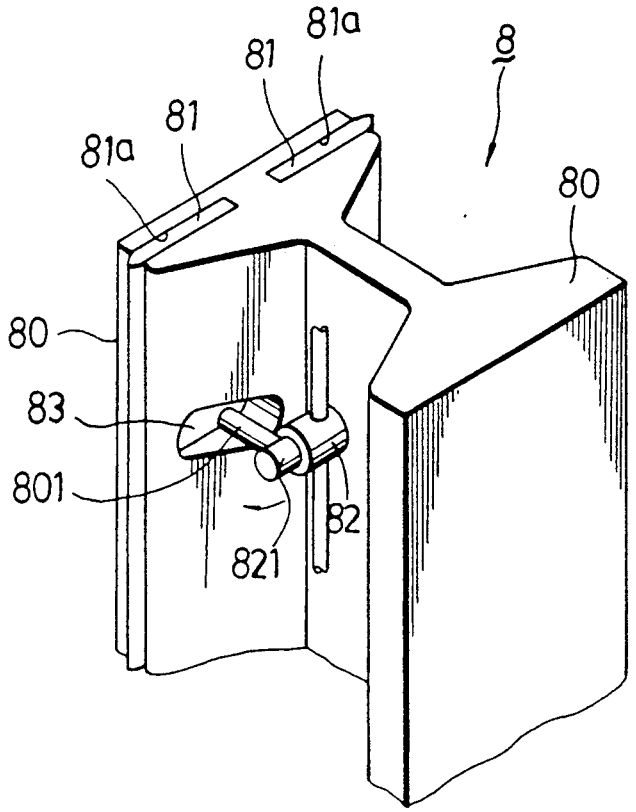
FIG. 14 shows a stop member of FIG. 13.

As shown in FIG. 14, each stop member 8 has two end members, 80 one of which is provided with two grooves 81*a* receiving two stop plate members 81. Two hydraulic operating members 82 (one is hidden and cannot be seen in FIG. 5) are attached to two sides of the intermediate portion of the stop member 8. Each hydraulic operating member 82 has a piston 821 connected to an operating rod 801, which passes through a slide opening 83 of the end member 80 and is connected to one of the stop plate members 81. When the pistons 821 of the operating members 82 are caused to extend outward, the stop plates 81 move outward and extend to two opposite walls confining the excavated cavity of the retaining wall so that concrete poured into the cavity is efficiently prevented from flowing out through the stop member 80 during the formation of the desired concrete wall section.

Reinforcement devices 1 to reinforce next sections of the retaining wall are lowered into hole sections subsequently excavated after the previous sections of the retaining wall are formed and the stop members 8 are removed therefrom by lifting devices. The ends of the next reinforcement devices 1 are connected to the concaved inner sides of the previously provided and exposed channel-like joint plates 7. It can be appreciated that the channel-like joint plate 7 not only interconnect adjacent reinforcement devices 1 but also permit the next section of the cast retaining wall to overlap the previous section of the retaining wall.

Figure 15:
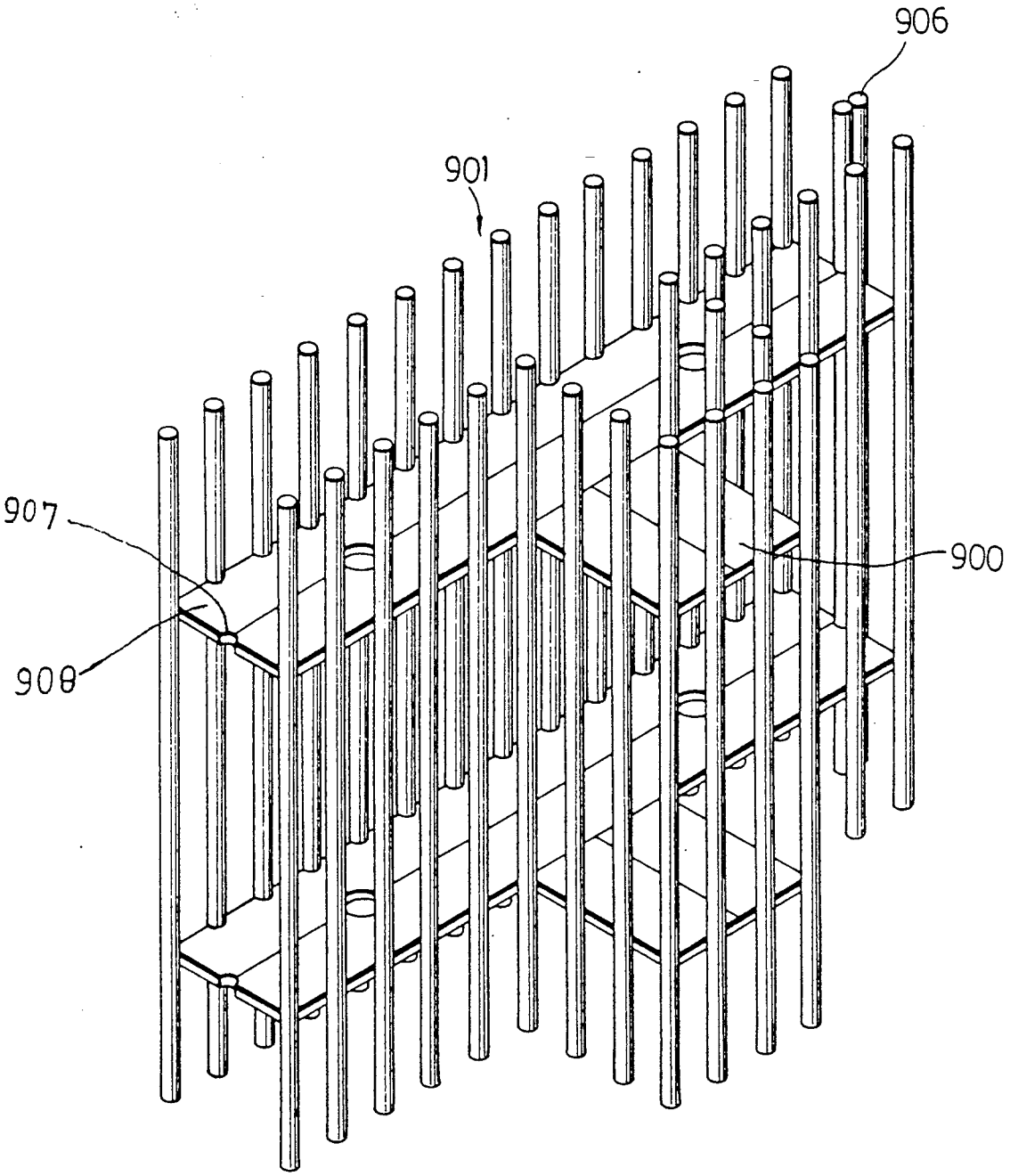
FIG. 15 shows a reinforcement device used for the construction of a retaining wall with a wall anchorage.
Figure 16:
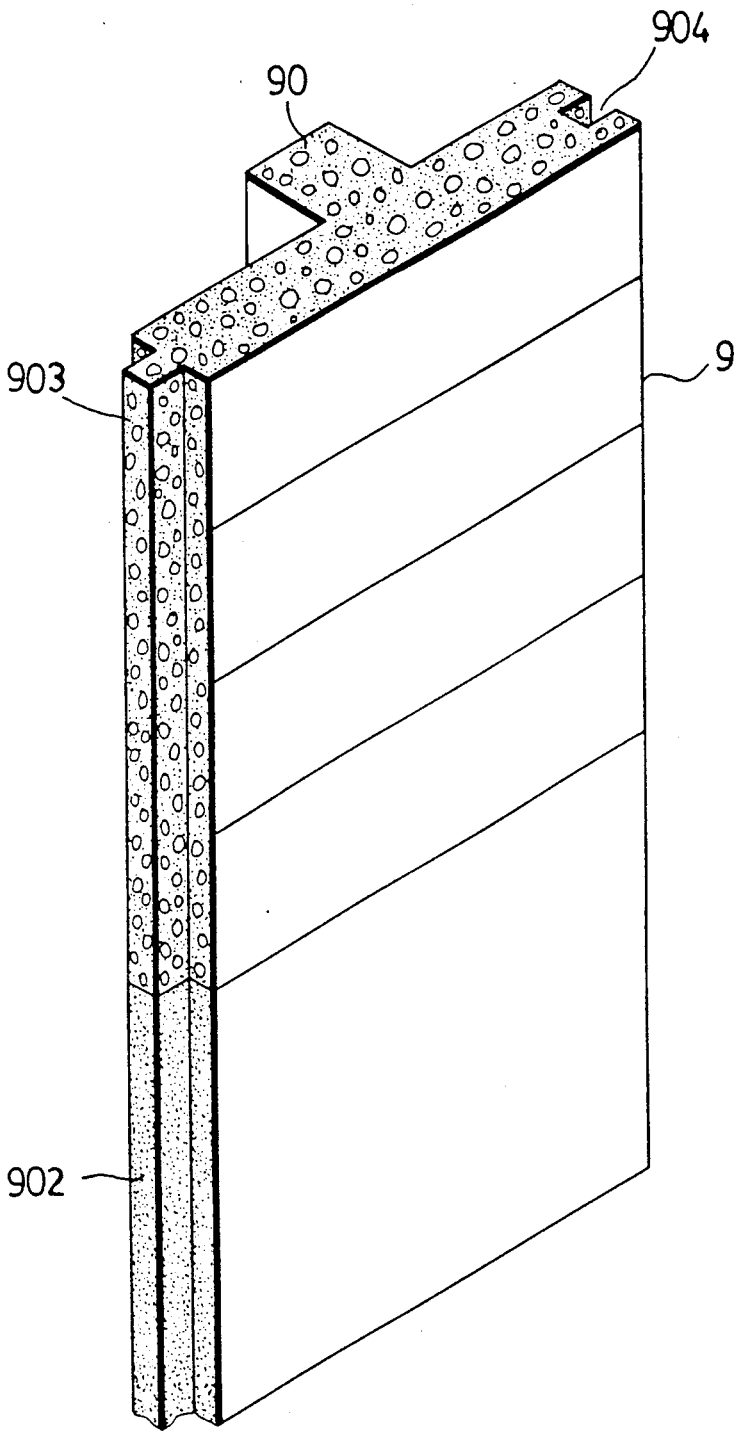
FIG. 16 is a fragmentary view of a retaining wall with a wall anchorage.

Referring to FIGS. 15 and 16, the reinforcement device of the present invention can also be used for constructing a retaining wall 9 with a wall anchorage 90. For the retaining wall 9, a reinforcement device 901 similar to the reinforcement device 1 is associated with a side reinforcement device 900 which is also similar in construction to the reinforcement device 1. The length of the side reinforcement device 900 is shorter than that of the reinforcement device 901 and is welded to the reinforcement device 901. Reference numeral 902 represents a cushion member provided at the bottom end of the retaining wall 9. The protrusion 903 is formed due to the presence of a side reinforcement rod 906 and a groove 904 results from a notch 907 of the horizontal plate 908. Two or more retaining walls 9 can be interlocked by using the grooves 904 and the protrusions 903.

Figure 17:
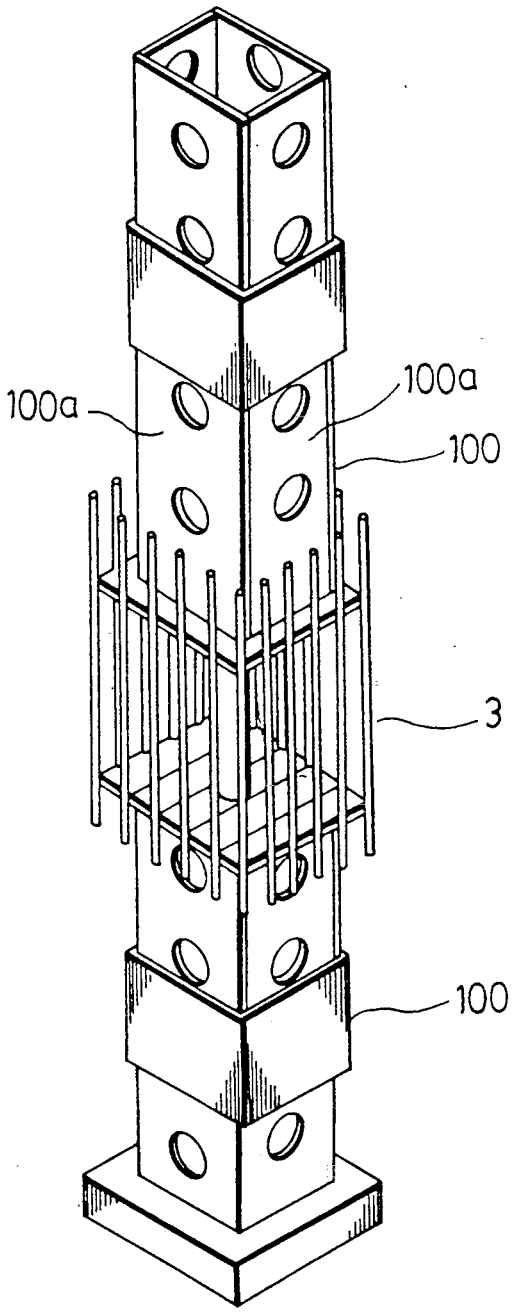
FIG. 17 shows a combination having the reinforcement device of FIG. 9 and reinforcement steel panels.

Referring to FIG. 17, the reinforcement device 3 of FIG. 9 is used for the formation of a concrete column in combination with upper and lower reinforcement devices 100. Each reinforcement device 100 is a hollow structure of rectangular cross-section comprising four steel panels 100*a* which are welded to each other.

With the invention thus explained, it is apparent that various modifications and variations can be made without departing from the scope of the invention. It is therefore intended that the invention be limited only as indicated in the appended claims.

What is claimed is:

1. A device for reinforcing a concrete construction comprising a plurality of spaced vertical reinforcement rods, and tiers of horizontal connecting plate means to space and interconnect the reinforcement rods, each of said connecting plate means having a peripheral edge provided with spaced notches which are engaged with said vertical reinforcement rods respectively and connected firmly thereto by welding means, each of said connecting plate means having a hole for the passage of concrete.

2. A device for reinforcing a concrete construction as claimed in claim 1, further comprising a cover plate extending transversely relative to said vertical reinforcement rods and having one side contacted with parts of said vertical reinforcement rods, said cover plate being removably attached to said vertical reinforcement rods and covering parts of said vertical reinforcement rods which are then exposed after the formation of the concrete construction.

3. A device for reinforcing a concrete construction as claimed in claim 1, further comprising transverse rods to be welded to the exposed parts of said vertical reinforcement rods.

4. A device for reinforcing a concrete construction as claimed in claim 1, further comprising transverse steel plates provided around parts of said vertical reinforcement rods, each having one side welded to said vertical reinforcement rods, each of said steel plates having openings in alignment with said openings of another opposite one of said steel plates, and tube members extending between said steel plates and each having two ends fitted in said aligned openings of said steel plates.

5. A device for reinforcing a concrete construction as claimed in claim 1, wherein said connecting plate means in each tier includes a plurality of interconnected plates.

* * * * *